United States Patent [19]

Müller et al.

[11] Patent Number: 4,909,215

[45] Date of Patent: Mar. 20, 1990

[54] ARRANGEMENT FOR PREVENTION OF TROUBLESOME LOAD CHANGE SHOCKS IN A VEHICLE COMBUSTION ENGINE

[75] Inventors: Eckart Müller, Gifhorn; Richard Dorenkamp, Isenbüttel, both of Fed. Rep. of Germany

[73] Assignee: Volkswagen AG, Wolfsburg, Fed. Rep. of Germany

[21] Appl. No.: 368,973

[22] Filed: Jun. 20, 1989

Related U.S. Application Data

[63] Continuation of Ser. No. 206,874, Jun. 9, 1988, abandoned.

[30] Foreign Application Priority Data

Jun. 19, 1987 [DE] Fed. Rep. of Germany ..... 3720350

[51] Int. Cl.[4] ..... F02M 39/00

[52] U.S. Cl. ..... 123/370; 123/399; 123/506

[58] Field of Search ..... 123/370, 506, 496, 198 DB, 123/449, 419, 436, 361, 399

[56] References Cited

U.S. PATENT DOCUMENTS

| | | | |
|---|---|---|---|
| 4,323,042 | 4/1982 | Woodhouse | 123/419 |
| 4,343,278 | 8/1982 | Asano | 123/419 |
| 4,397,280 | 8/1983 | Yasuhara | 123/370 |
| 4,480,619 | 11/1984 | Igashira | 123/458 |
| 4,495,915 | 1/1985 | Shinoda | 123/458 |
| 4,508,078 | 4/1985 | Takeuchi | 123/399 |
| 4,515,126 | 5/1985 | Kessler | 123/399 |
| 4,520,780 | 6/1985 | Ito | 123/458 |
| 4,535,742 | 8/1985 | Laufer | 123/506 |
| 4,543,933 | 10/1985 | Kessler | 123/399 |
| 4,640,243 | 2/1987 | Abo | 123/399 |
| 4,656,986 | 4/1987 | Kull | 123/419 |
| 4,665,878 | 5/1987 | Takeuchi | 123/492 |
| 4,811,713 | 3/1989 | Shimada | 123/361 |
| 4,819,598 | 4/1989 | Mueller | 123/399 |

FOREIGN PATENT DOCUMENTS

| | | | |
|---|---|---|---|
| 0155993 | 10/1984 | European Pat. Off. . | |
| 1451961 | 9/1969 | Fed. Rep. of Germany | 123/370 |
| 3114836 | 11/1982 | Fed. Rep. of Germany | 123/399 |
| 3122666 | 1/1983 | Fed. Rep. of Germany | 123/370 |
| 0012048 | 1/1979 | Japan | 123/370 |
| 0041437 | 3/1982 | Japan | 123/399 |
| 0093939 | 6/1983 | Japan | 123/370 |
| 2165895 | 4/1986 | United Kingdom | 123/506 |

*Primary Examiner*—Carl Stuart Miller

*Attorney, Agent, or Firm*—Brumbaugh, Graves, Donohue & Raymond

[57] ABSTRACT

In the embodiments of the invention described in the specification, a fuel injection pump for an internal combustion engine provides a delayed response to accelerator pedal depression for a selected time period including the time when the engine load passes through zero, thereby avoiding load shock changes. For this purpose, a throttle or bypass valve is provided which decreases the amount of fuel provided to the engine to the zero load fuel demand for the selected time period.

11 Claims, 3 Drawing Sheets

Fig.1
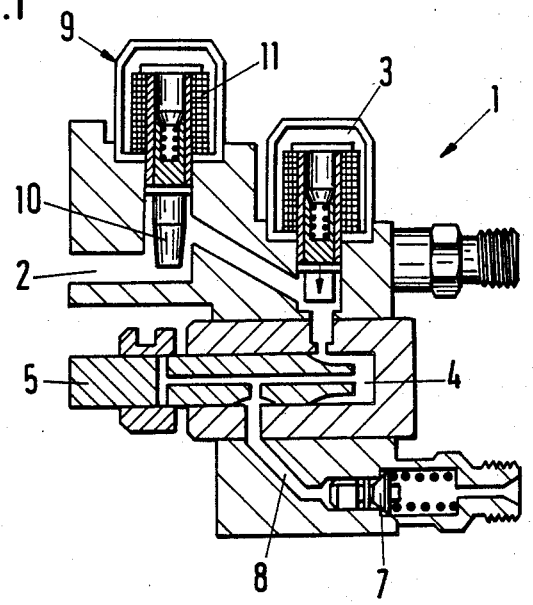
Fig.2
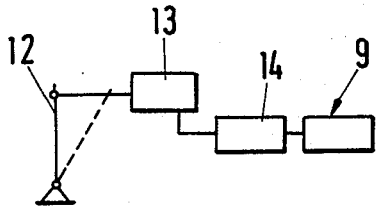
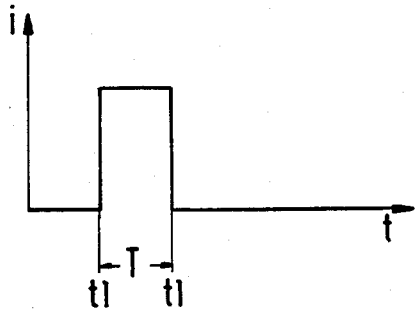
Fig.3
Fig.4
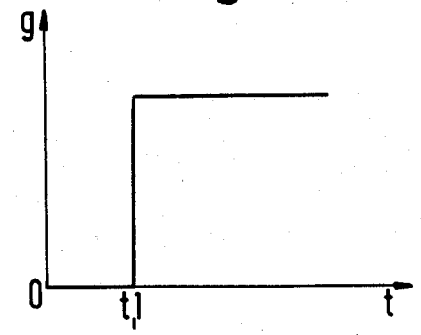
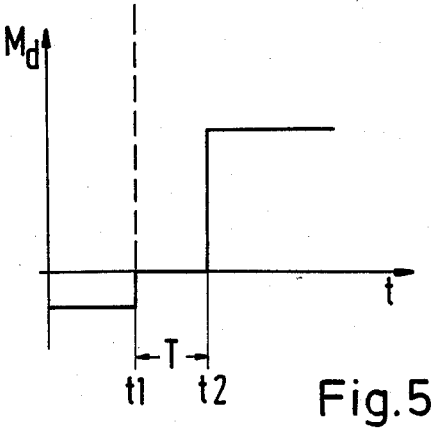
Fig.5

ARRANGEMENT FOR PREVENTION OF TROUBLESOME LOAD CHANGE SHOCKS IN A VEHICLE COMBUSTION ENGINE

This application is a continuation of Ser. No. 206,874, filed on June 9, 1988, now abandoned.

BACKGROUND OF THE INVENTION

This invention relates to arrangements for preventing load change shocks in an internal combustion engine and, more particularly, to a new and improved arrangement for preventing such load shock.

In automobiles equipped with internal combustion engines, a so-called load change shock will occur on transition from engine braking operation to driving operation. Such shock may lead to longitudinal oscillations of the vehicle called jerking, especially at low engine speeds. This phenomenon is essentially caused by the kinetic energy of the combustion engine and the drive train which is released during a change in the direction of the load applied to the drive train because of elasticities and plays in the drive train and is partly transmitted to the body of the vehicle. Jerking resulting from such load changes can therefore be largely prevented if the kinetic energy built up during the load change is reduced to a minimum. This object is achieved by the arrangements described in the co-pending Müller Application Ser. No. 123,962, filed Nov. 23, 1987 and assigned to the same assignee as the present application, and in the published European Application No. 0 155 993. In the arrangements disclosed in those applications, the control commands to the power control element, e.g., a throttle valve or a control rod of an injection device, resulting from accelerator pedal actuation are transmitted with delay, i.e., with flattening and consequent prolongation of the increase in the level of the control signal.

Such delay in the transmission of an accelerator pedal command is undesirable, at least during normal operation of the combustion engine. However, in accordance with the present state of the art, such delays are accepted within a relatively large control range so that even more unacceptable instabilities of vehicle dynamics can be avoided or be reduced to an acceptable level.

In order to reduce undesirable load change phenomena to an acceptable level, the arrangement described by the abovementioned co-pending application provides a delay in accelerator pedal command transmission which is limited to a very small time range of the torque characteristic of the internal combustion engine, i.e., in the immediate vicinity of the passage of the torque characteristic through zero. This procedure relies on the fact that it is essentially only the sign reversal of the torque on transition from engine braking to driving which is responsible for the load change shock.

Whereas thus the co-pending application identified above produces a desired result by acting on the transmission of the acceleration command issued by the accelerator pedal, the arrangement according to the unpublished German Patent Application No. P 37 16 042.7 eliminates such a delayed transmission of a command signal. According to this application, rapid accelerator pedal movements cause a suppression of injection pulses to the injection pump in such a manner that initially a large number of injection pulses are suppressed whereas, during subsequent operation of the engine, the number of suppressed injection pulses is continuously reduced until finally all injection pulses are again provided. According to that patent application, an idle shut-off valve which is present in the system can be used for suppression of the pulses.

Thus, in accordance with the latter arrangement, injection pulses are completely suppressed and, as a result, a series of cylinder disconnections occurs. Contrary to the arrangement described in the co-pending Müller patent application, the last-mentioned German patent application does not provide for any limitation of the pulse control suppression to the region of the zero passage of the torque curve.

SUMMARY OF THE INVENTION

Accordingly, it is an object of the present invention to provide a new and improved arrangement for preventing load change shocks in internal combustion engines which overcomes the above-mentioned disadvantage of the prior art.

Another object of the invention is to provide an arrangement for preventing load change shocks which can be operated with little effort in electronically, as well as mechanically, controlled fuel injection engines.

These and other objects of the invention are attained by providing an arrangement in which a valve associated with the fuel injection pump of an internal combustion engine is actuated at the start of accelerator pedal depression for a predetermined time interval to limit the flow of fuel to the engine during the time of approximately zero load on the engine.

The special advantage of the invention results from its surprising simplicity: i.e., upon motion of the accelerator pedal from the zero-load or idling position, fuel delivery is reduced to the zero-load requirement of the internal combustion engine during a predetermined time span which, in accordance with experience, contains the zero passage of the torque characteristic of the system. Again, the idle shut-off valve can be utilized if it is constructed according to claim 4.

BRIEF DESCRIPTION OF THE DRAWINGS

Further objects and advantages of the invention will be apparent from a reading of the following description of particular embodiments in conjunction with the accompanying drawings, in which:

FIG. 1 is a sectional view through the parts of the injection pump for an internal combustion engine of the Diesel type, not shown, illustrating a representative embodiment of an arrangement according to the present invention;

FIG. 2 is a schematic circuit diagram for actuation of the device shown in FIG. 1;

FIG. 3 is a graphical representation showing the time behavior of the exciting current for the valve in FIG. 1;

FIG. 4 is a graphical representation showing the time behavior of the accelerator pedal motion;

FIG. 5 is a graphical representation showing the time behavior of the torque curve obtained by the embodiment shown in FIG. 1;

DESCRIPTION OF PREFERRED EMBODIMENTS

Figure 6:
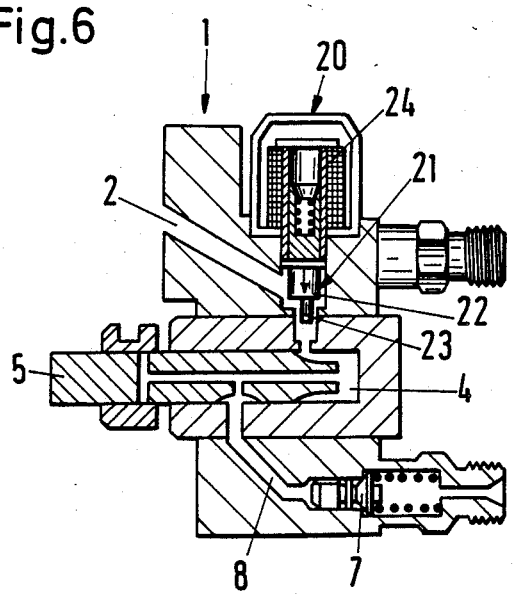
FIG. 6 is a view similar to that of FIG. 1 showing a simplified form of the embodiment shown in FIG. 1.

Referring first to FIG. 1, a fuel injection pump 1 having a generally conventional structure includes an intake port 2 with a shut-off valve 3 and a high-pressure or pump chamber 4 and a pump piston 5. Depending on its rotary position, the pump piston 5 provides communication between the pump chamber 4 and one of a series of outlet lines 8, only one of which is shown in FIG. 1. Each outlet line 8 is equipped with a check valve 7 and leads to the injection nozzle of one of the engine cylinders. Further details are not described herein since the construction and operation of such injections pumps are know to those skilled in the art.

In series with the shut-off valve 3, there is an electromagnetically-actuated throttle valve 9 having a profiled throttle pin 10 shown in its operating position which provides only a limited-flow cross-section in the intake port 2. The flow cross-section in the illustrated position is dimensioned so that only the fuel requirement for the combustion engine at zero load is provided.

By controlling the current applied to the exciter coil 11 of the throttle valve 9, the throttle pin 10 in FIG. 1 is moved upward into a retracted position in which the full-flow cross-section of the intake port 2 is provided during normal operation of the internal combustion engine, and the throttle pin 10 is moved for a predetermined short time period ranging from approximately 0.03 to 0.5 seconds into the throttle position shown in the drawing only at the start of the accelerator pedal movement away from its zero-load position. This time period is chosen so that it covers the zero passage of the torque characteristic curve of the internal combustion engine, which will be further explained hereinafter with reference to FIGS. 4 and 5.

FIG. 2 shows a circuit diagram for the actuation of the throttle valve 9. On the schematically illustrated accelerator pedal 12, there is a position sensor 13 which delivers a pulse to a control device 14 at the start of the motion of the accelerator pedal from its rest position. The control device 14 is a pulse generator which generates a pulse having a duration of approximately 0.03 to 0.5 seconds causing the throttle pin 10 of the throttle valve 9 to move into its throttling position shown in FIG. 1. Normally, a closed-circuit connection is provided for the exciter winding 11 so that, after actuation of the ignition lock, the throttle pin is moved into its retracted position and is held there. Then, as soon as the accelerator pedal leaves its rest position and the switch 13 becomes effective, the pulse generated in the control device 14 interrupts the closed circuit for the preset time span so that the throttle pin is moved into the throttling position shown in FIG. 1 by the action of a spring.

FIG. 3 shows the actuating current i, plotted against time t, produced by the control device for the solenoid valve 9 without consideration of current direction. The movement of the accelerator pedal 12 from its rest position starts at the time t1. Following a signal from the position sensor 13, the current i flowing through the exciter winding 11 is modified during a predetermined time span T so that the throttle pin 10 reaches its effective position, from which it is retracted again at the time t2, i.e., at the end of the predetermined time span T. Prior to the time t1, enginebraking operation is present and at the time t2 the drive operation of the internal combustion engine starts, obviously after a short transitional phase.

In FIG. 4 the movement g (i.e., the angle-of-advance or setting path) of the accelerator pedal is plotted against time t wherein a very rapid accelerator pedal actuation at the time t1 is assumed. Because of the arrangement according to the invention as described above, a gradient in the torque $M_d$ of the internal combustion engine is produced, which is plotted against time t in FIG. 5. During engine braking, i.e., prior to the time t1, the combusiton engine obviously does not generate any positive torque. Such positive torque also does not occur directly at the time t1, i.e., at the start of the movement of the accelerator pedal out of its zero position. Instead, it occurs starting at point t2, which is delayed from the time t1 by a preset time period T. During the preset time period T, the internal combustion engine is supplied with only enough fuel to cover its zero load requirement so that an abrupt transition from engine braking to driving is avoided.

Whereas in the example described above, a separate throttle valve is provided in series with the shut-off valve, FIG. 6, wherein parts corresponding to those of FIG. 1 have the same reference numerals, shows an injection pump in which the shut-off valve and the throttle valve are combined. In this arrangement, a combined valve 20 has a pin 21 with a shut-off portion 22 and a throttle portion 23. In the position of the pin 21 shown in the drawing, the throttle position 23 is effective, i.e., the condition during the preset time period T is shown. During the preset time period, an exciter winding 24 receives an exciting current which is intermediate between the exciter current applied during idling, when the pin 21 in FIG. 6 is moved further downward as viewed in FIG. 6 so that its shut-off portion 22 is effective, and the exciting current applied during normal engine operation, when the throttle pin 21 is pulled all the way up from the position shown in FIG. 6.

Figure 7:
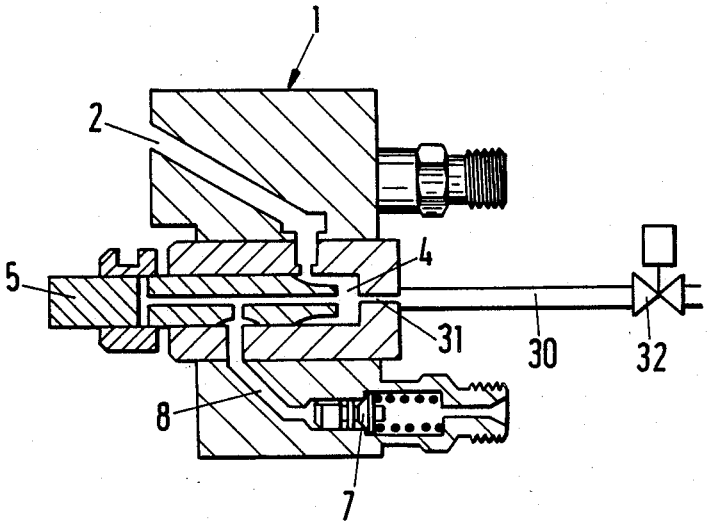
FIG. 7 is a sectional view, partly schematic, showing another arrangement for short-time limitation of the fuel quantity delivered by a fuel pump in accordance with the invention.

In the embodiment shown in FIG. 7, a bypass line 30 with a throttle 31 and a shut-off valve 32 extends from the pump chamber 4 in parallel with the outlet lines 8. During normal operation of the internal combustion engine, the shut-off valve 32 is closed so that the quantities of fuel delivered to the injection nozzles are not influenced by the valve. During a load change, however, the shut-off valve 32 is opened for a preset time period, again caused by the accelerator pedal position sensor, so that the portion of the fuel quantity exceeding the zero load demand of the engine, which otherwise would reach the outlet lines 8, is drawn off through the throttle 31. In principle, this provides the torque gradient explained previously with reference to FIG. 5.

Figure 8:
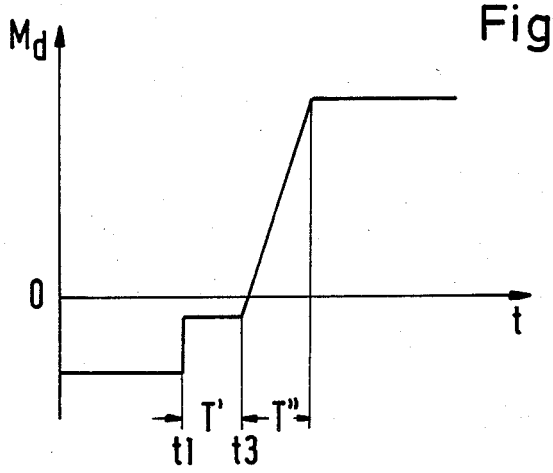
FIGS. 8 and 9 are graphical representations showing the time behavior of the torque curve which may be obtained with the arrangement shown in FIG. 7.
Figure 9:
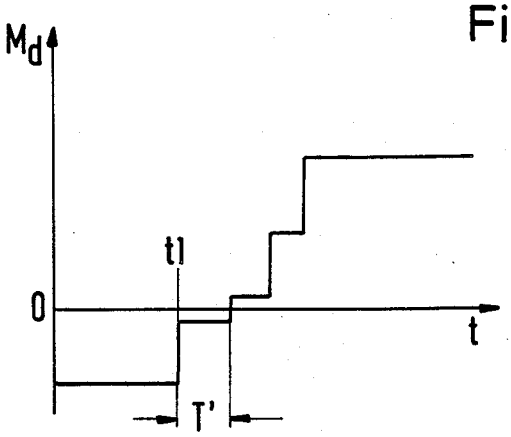

It may also be useful to control the shut-off valve 32 so that, after the preset time period, it opens slowly or in steps instead of opening abruptly. FIGS. 8 and 9 illustrate this. These graphs again represent the variation with time of the torque $M_d$ delivered by the internal combustion engine wherein an abrupt depression of the accelerator pedal at the time t1 is assumed. Viewing first the graph in FIG. 8, it will be noted that, as a result of the start of the accelerator pedal movement at the time t1, the shut-off valve 32 (FIG. 7) is fully opened for a preset time period T' and thereafter is continuously closed again during a time period T'' starting at a time t3. The torque remains constant during the time period t', i.e., in the vicinity of the zero passage of the torque and thereafter a continuous increase occurs.

A similar result is obtained with a stepwise return of the shut-off valve 32 to its closed position as shown in FIG. 9.

Figure 10:
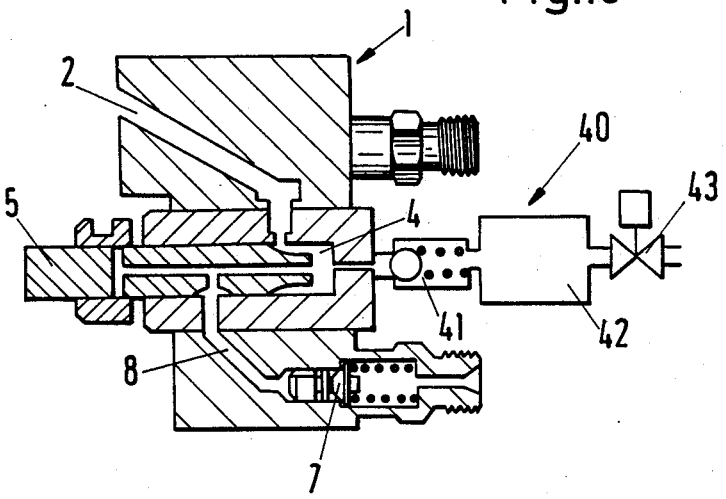
FIG. 10 is a sectional view, partly schematic, showing a further embodiment according to the invention.

In the embodiment shown in FIG. 10, in which parts corresponding to those of the prior embodiments have the same reference numerals, a specially designed bypass line 40 is associated with the pump chamber 4. The bypass line 40 contains a check valve 41, a buffer space 42 and a shut-off valve 43, connected in series. This arrangement generates a torque gradient corresponding to FIG. 8.

During normal operation of the internal combustion engine, the shut-off valve 43 is closed and the buffer space 42 is subjected to a pressure which corresponds approximately to the highest delivery pressure of the injection pump 1. This means that all of the fuel delivered by the pump normally reaches the injection nozzles.

On transition from engine braking to driving, i.e., during a load change, the shut-off valve 43 is opened for a short time, which may be a maximum of 0.1 second, during which the pressure in the buffer space 42 is reduced. This opens the check valve 41 so that part of the fuel delivered to the chamber 4 reaches the buffer space 42 via the throttle. Due to the compression of the fuel, increasing pressure is built up in the space 42 so that the proportion of the fuel reaching the buffer space becomes smaller and smaller from injection to injection and finally becomes zero. As a result, the proportion of the fuel delivered to the injection nozzles increases steadily.

A special advantage of this arrangement results from the fact that critical actuation times for the shut-off valve 43, i.e., those which must be adhered to precisely, can be avoided. The valve needs to be actuated only for a short time.

Therefore, by application of the invention, a fuel injection arrangement is provided in which the fuel delivered to the engine upon a change of load is limited for a selected period of time including the zero-load time and which can also be utilized in mechanically-controlled fuel injection gasoline or diesel engines and which operates with especially small effort. The description of the various embodiments shows that electronic-characteristic memories and the like are not required.

Although the invention has been described herein with reference to specific embodiments, many modifications and variations therein will readily occur to those skilled in the art. Accordingly, all such variations and modifications are included within the intended scope of the invention.

We claim:

1. An arrangement for inhibiting load change shocks in a fuel-injection internal combustion engine for driving a vehicle comprising a fuel injection pump for supplying fuel to the internal combustion engine, a valve associated with the fuel injection pump and an accelerator pedal position sensor responsive to accelerator pedal motion to control the valve to limit the fuel quantity reaching the injection nozzle only at the start of accelerator pedal motion out of the zero engine load position during a preset time period which is independent of the rate of accelerator pedal motion to approximately zero external load demand of the internal combustion engine.

2. An arrangement according to claim 1 wherein the preset time period ranges from approximately 0.03 to 0.5 second.

3. An arrangement according to claim 1 or claim 2 wherein the valve is a throttle valve arranged in a feed line for the fuel injection pump.

4. An arrangement according to claim 3 wherein the throttle valve comprises a cut-off valve having a pin determining the flow cross-section which can be moved into an open position, a throttle position and a shut-off position.

5. An arrangement according to claim 1 wherein the valve is a bypass valve arranged parallel to the outlet of the fuel injection pump.

6. An arrangement according to claim 5 wherein the preset time period ranges from approximately 0.03 to 0.5 second.

7. An arrangement according to claim 5 wherein the bypass valve which has only an open position and a closed position and including a fixed throttle arranged in series with the bypass valve.

8. An arrangement according to any one of claims 5 to 7 including means for delaying the opening and the closing of the valve.

9. An arrangement according to claim 5 or claim 7 including a buffer space and a check valve preceding the bypass valve.

10. An arrangement according to claim 7 wherein the preset time period for the bypass valve is approximately 0.1 second.

11. An arrangement according to claim 9 wherein the preset time period for the bypass valve is approximately 0.1 second.

* * * * *

UNITED STATES PATENT AND TRADEMARK OFFICE

CERTIFICATE OF CORRECTION

PATENT NO. : 4,909,215

DATED : March 20, 1990

INVENTOR(S) : Eckart Muller et al.

It is certified that error appears in the above-identified patent and that said Letters Patent is hereby corrected as shown below:

TITLE PAGE: 2nd Column, add to the list of FOREIGN PATENT DOCUMENTS the following:

--2401728 12/1983 Federal Republic of Germany
3612194 10/1986 Federal Republic of Germany--.

Signed and Sealed this

Eighth Day of October, 1991

*Attest:*

HARRY F. MANBECK, JR.

*Attesting Officer*

*Commissioner of Patents and Trademarks*